US010138685B1

(12) United States Patent
Eggers

(10) Patent No.: US 10,138,685 B1
(45) Date of Patent: Nov. 27, 2018

(54) DRILLING SYSTEM WITH TEETH DRIVEN IN OPPOSITE DIRECTIONS

(71) Applicant: Jeffrey Eggers, Newport Beach, CA (US)

(72) Inventor: Jeffrey Eggers, Newport Beach, CA (US)

( * ) Notice: Subject to any disclaimer, the term of this patent is extended or adjusted under 35 U.S.C. 154(b) by 266 days.

(21) Appl. No.: 15/130,815

(22) Filed: Apr. 15, 2016

Related U.S. Application Data

(60) Provisional application No. 62/269,909, filed on Dec. 18, 2015.

(51) Int. Cl.
*E21B 11/06* (2006.01)

(52) U.S. Cl.
CPC ..... *E21B 11/06* (2013.01)

(58) Field of Classification Search
CPC ..... E21B 10/006; E21B 11/06
See application file for complete search history.

(56) References Cited

U.S. PATENT DOCUMENTS 1,643,549 A * 9/1927 Donnelly ..... E21B 11/06 173/140
2,653,794 A * 9/1953 Straitiff ..... E21B 11/06 173/59
2,673,407 A * 3/1954 Williams ..... E21B 11/06 37/300
2,880,964 A * 4/1959 Straitiff ..... E21B 11/06 173/59
3,127,006 A 3/1964 Tochtermann et al.
3,391,751 A * 7/1968 Caro ..... E02D 17/13 175/272
3,661,137 A 5/1972 Prowse et al.
3,910,147 A 10/1975 Heyerdahl
3,958,332 A 5/1976 Gates et al.
4,151,754 A 5/1979 Reist
4,394,882 A 7/1983 Ritter et al.
4,518,022 A 5/1985 Valdes et al.
4,619,172 A 10/1986 Perez
4,674,474 A 6/1987 Baril
4,793,232 A 12/1988 Villemin et al.
4,907,564 A 3/1990 Sowa et al.
5,226,404 A 7/1993 Mogi et al.
D359,968 S 7/1995 Ekblad et al.
(Continued)

OTHER PUBLICATIONS

Ho et al., Design and evaluation of a grapevine pruner for biofungicide application, Bioresource Technology 96 (2005), p. 963-968.

*Primary Examiner* — Robert E Fuller
(74) *Attorney, Agent, or Firm* — Knobbe, Martens, Olson & Bear, LLP

(57) ABSTRACT

A drilling system can include a drill bit defining a longitudinal axis between distal and proximal ends. The drill bit can be configured to rotate about the longitudinal axis and to cut material at the distal end. The drill bit can include a plurality of chain assemblies; each chain assembly can comprise a set of cogs and a chain. The chain can be made up of a plurality of links, each link having teeth positioned in rows extending radially around the link, the teeth configured to rotate axially around the chain as the teeth engage a material for cutting. The plurality of chain assemblies can comprise at least a first chain assembly and a second chain assembly which are driven in opposite directions.

12 Claims, 10 Drawing Sheets

(56) References Cited

U.S. PATENT DOCUMENTS

| | | | |
|---|---|---|---|
| 5,718,216 | A | 2/1998 | Plattner |
| 5,988,035 | A | 11/1999 | Rossmann |
| 6,021,773 | A | 2/2000 | Svensson |
| 6,178,960 | B1 | 1/2001 | Svensson |
| 6,413,915 | B1 | 7/2002 | Stehr |
| 6,446,621 | B1 | 9/2002 | Svensson |
| 6,837,138 | B2 | 1/2005 | Mang |
| 6,991,094 | B2 | 1/2006 | Frost |
| 7,044,025 | B2 | 5/2006 | Rohrich et al. |
| 2003/0167895 | A1 | 9/2003 | Mang |
| 2005/0178263 | A1 | 8/2005 | Szymanski |
| 2007/0137632 | A1 | 6/2007 | Steiner et al. |
| 2011/0072944 | A1 | 3/2011 | Eggers |

* cited by examiner

DRILLING SYSTEM WITH TEETH DRIVEN IN OPPOSITE DIRECTIONS

INCORPORATION BY REFERENCE TO ANY PRIORITY APPLICATIONS

This application claims the benefit of priority under 35 U.S.C. § 119(e) of U.S. Prov. Appl. No. 62/269,909, filed Dec. 18, 2015, the entirety of which is incorporated by reference herein and considered a part of this specification. Any application for which a foreign or domestic priority claim is identified in the Application Data Sheet as filed with the present application is hereby incorporated by reference under 37 CFR 1.57.

BACKGROUND

Field

The present disclosure relates generally to drills, drill bits, blades, and other cutting, boring, reaming and/or drilling tools. In particular, the present disclosure relates to drilling systems, such as those for hard rock drilling used for oil and gas, mining, drilling for water, etc.

Description of Certain Related Art

In various industries, such as the oil and gas, and well water industries, a drill bit is used to produce a generally cylindrical hole (wellbore) in the earth's crust. Many of these drill bits work by rotary drilling into the ground. The hole diameter produced by these types of drill bits is typically quite small (from about 3.5 inches to 30 inches) compared to the depth of the hole produced (from a few hundred feet to more than 30,000 feet). Subsurface formations are broken apart mechanically by cutting elements of the bit by scraping, grinding or localized compressive fracturing. The cuttings produced by the bit are typically removed from the wellbore and continuously returned to the surface by direct circulation.

SUMMARY

There exists a need for improved drill bits and drilling systems.

A drilling system can include a drill bit defining a longitudinal axis between distal and proximal ends. The drill bit can be configured to rotate about the longitudinal axis and to cut material at the distal end. The drill bit can include a plurality of chain assemblies, each chain assembly can comprise a set of cogs and a chain. The chain can be made up of a plurality of links, each link having teeth positioned in rows extending radially around the link, the teeth configured to rotate axially around the chain as the teeth engage a material for cutting. The plurality of chain assemblies can comprise at least a first chain assembly and a second chain assembly which are driven in opposite directions.

Further, in some embodiments, the teeth on adjacent links of a chain assembly can rotate axially about said chain assembly in opposite directions when they engage a material for cutting. In still further embodiments, in addition, or instead, adjacent links on adjacent chains can be configured to rotate in opposite directions about their respective chains when they engage a material for cutting.

According to some embodiments, a drilling system can include a drill bit. The drill bit defines a longitudinal axis between a distal end and a proximal end. The drill bit is configured to rotate about the longitudinal axis and to cut material at the distal end. The drill bit can comprise a plurality of chain assemblies. Each of the plurality of chain assemblies can comprise a chain made up of a plurality of cutters, each cutter having teeth positioned in rows extending radially around the cutter, the teeth configured to rotate axially as the teeth engage a material for cutting; a proximal cog with a first set of gear teeth configured to drive the chain; and a distal cog configured with a second set of gear teeth configured to engage the chain, the drill bit configured to cut material with each chain at each distal cog. The plurality of chain assemblies can comprise at least a first chain assembly and a second chain assembly, the proximal cog of the first chain assembly configured to drive the first chain assembly in a direction opposite of the proximal cog of the second chain assembly. In a moment of time, the teeth on adjacent cutters of the first chain assembly can rotate axially in opposite directions when they engage a material for cutting.

BRIEF DESCRIPTION OF THE DRAWINGS

Various embodiments are depicted in the accompanying drawings for illustrative purposes, and should in no way be interpreted as limiting the scope of the inventions, in which like reference characters denote corresponding features consistently throughout similar embodiments.

DETAILED DESCRIPTION OF CERTAIN EMBODIMENTS

A drilling system can be used in a cutting or drilling tool for many different applications. For example, the drilling system may be used to drill a hole into the ground, rock, or other surface for water and/or oil, among other substances. The drilling system can be used as a drill bit. The drilling system can be used to bore a hole during various processes, such as fracking for example. The drilling system can also be used to ream a hole to form a consistent and/or smooth surface.

The various embodiments described herein provide a number of benefits and advantages. For example, a drilling apparatus can provide better control, a smoother bore, while increasing safety. The drilling apparatus can provide an increase in the smoothness of the drilled bore as compared to current designs. This is because the drilling apparatus can cut at its end, but also along its sides. Providing multiple cutting surfaces can increase the smoothness of each cutting pass with the drilling apparatus. This improved bore that can be cut with the drilling apparatus in believed to also increase the reliability of the cement sealing of the sides of the bore and the eventual capping of the bore.

Further, the drilling apparatus can cut when moving to the sides and also in reverse, such as when the drilling apparatus is being removed from a bore. This can save a substantial amount of time and money as opposed to current systems that do not cut or hone the bore as they are removed. In current systems it is often necessary for the drill to be run in the bore a second time to perform a wiper run.

It will be understood that after drilling, the earth, rock, soil, etc. has a tendency to move or shift. This can cause the drilling apparatus to get stuck. It is often the case where a drill apparatus is stuck to cut off the drill apparatus and to seal the bore. This results in a complete loss of the bore and drill bit end of the drilling apparatus. Reverse drilling, which can be performed by at least some embodiments can reduce the chances that the drilling apparatus will get stuck and cannot be removed from the bore.

Figure 1:
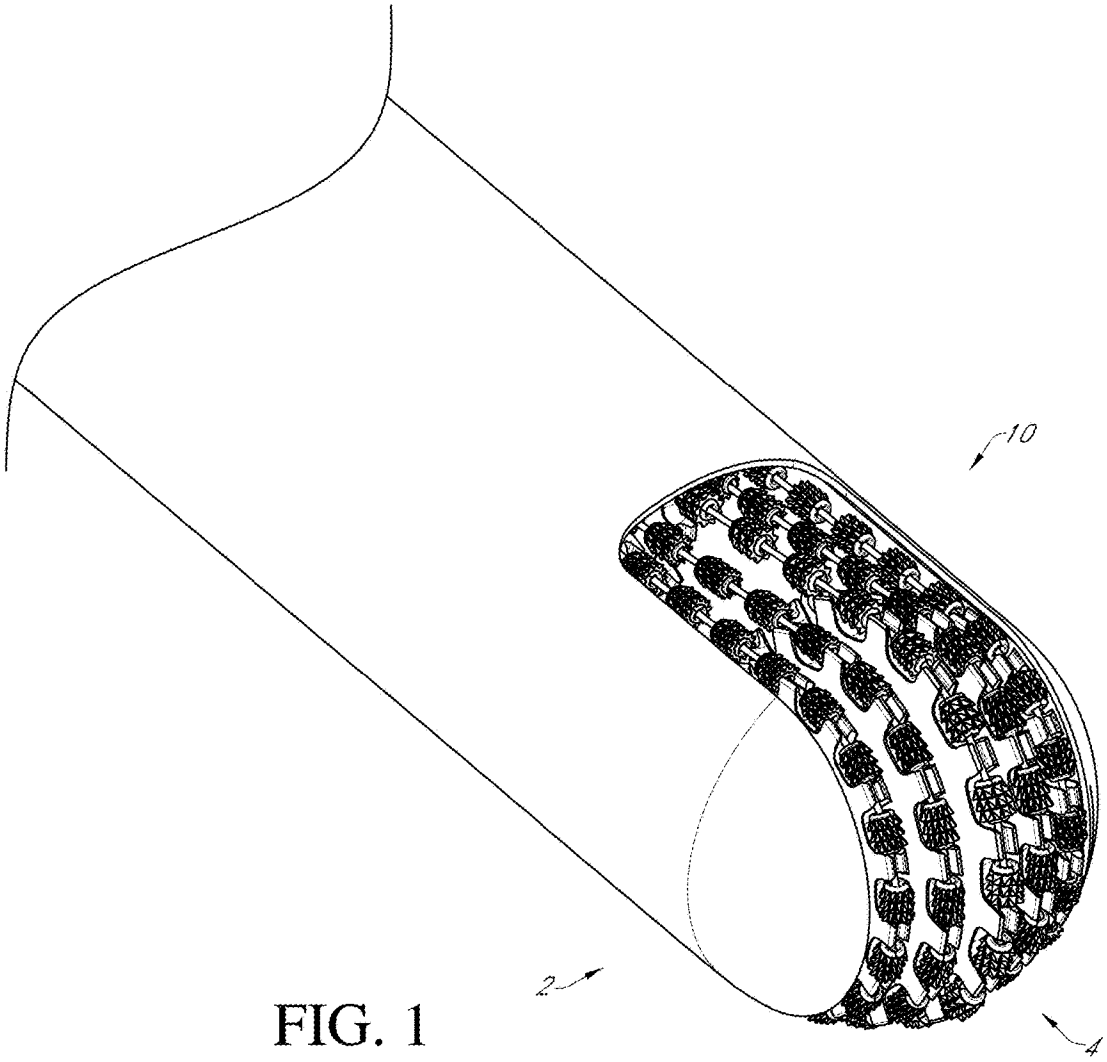
FIG. 1 is a perspective view of a drilling system.

FIG. 1 illustrates an embodiment of a drilling apparatus 10. The drilling apparatus 10 can include a drill bit 2 at a distal end. The drill bit 2 can be used to cut material with a plurality of chain assemblies 4. The drill bit can also include one or more nozzles and/or openings 6 that can be used to clean the cutters, and/or remove cut material from the area. The drill bit 2 may be configured to spin in a clockwise and/or counterclockwise direction around the longitudinal axis. Being able to turn forwards or backward can be advantageous to boring or reaming into rock and/or other surfaces because the drilling apparatus is less likely to bind or get stuck.

Figure 2:
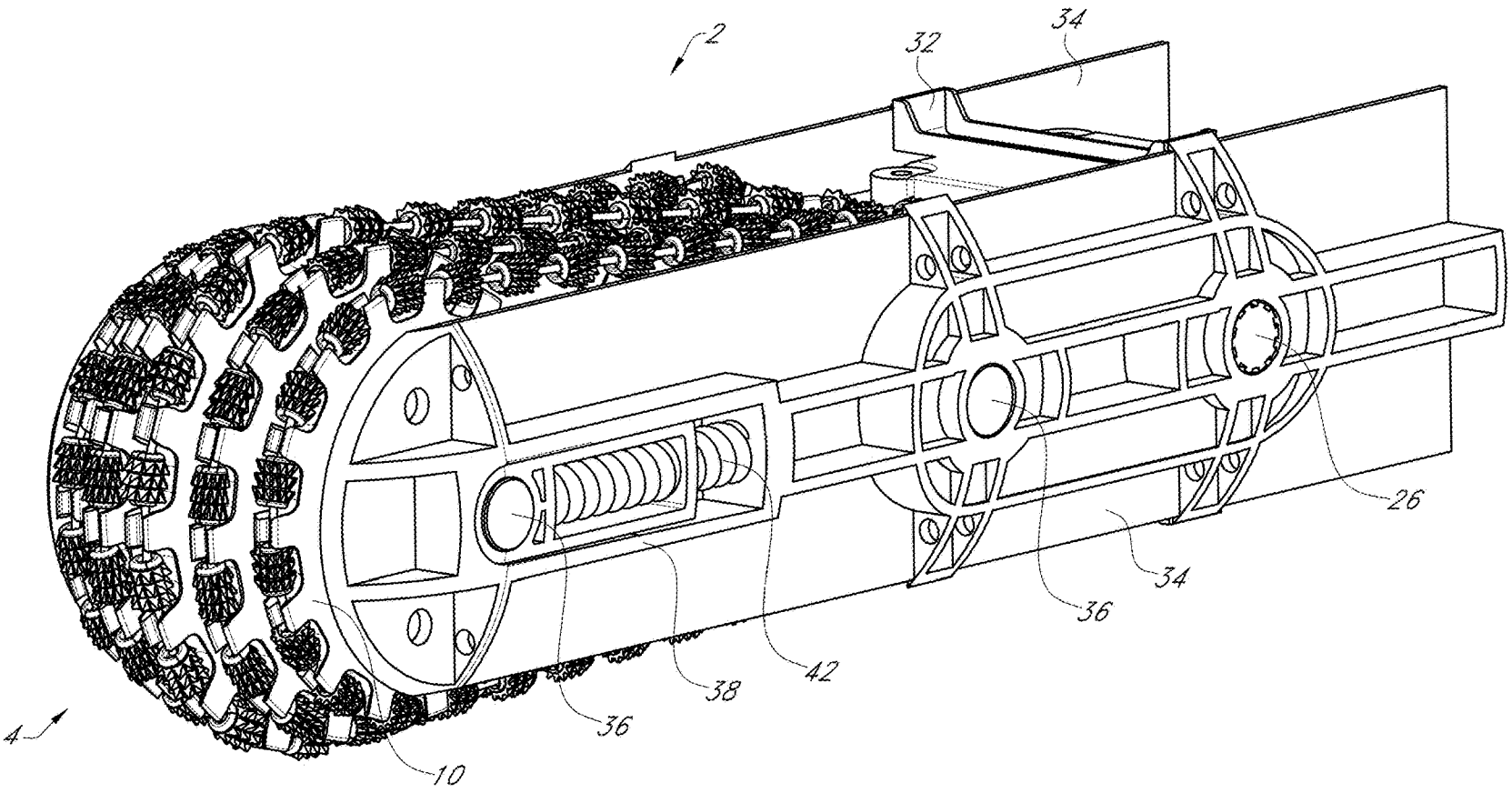
FIG. 2 is a perspective view of a drill bit of the drilling system.

Turning to FIG. 2, the drill bit 2 can be seen with the outer housing removed. The basic assembly of the drill bit 2 can be seen in the views of FIGS. 2-4. The drill bit can comprise a plurality of chain assemblies 4. Each of the chain assemblies 4 as seen in FIG. 4 is shown with a chain 8, a front sprocket 10, and a drive sprocket 12. A gear box 14 can be used to drive the chain assemblies. This can be done through another chain assembly with a chain 16, drive sprocket 20, and driven sprocket 22. An axle 36 may be coupled to the driven sprocket 22. Each of the one, two, three, four, five, six, seven, eight, nine, ten, or more chain assemblies may rotate about the axle independently in the same direction or opposite directions. In some embodiments, each of the one, two, three, four, five, six, seven, eight, nine, ten, or more chain assemblies may be axially aligned adjacent to one another.

In some embodiments, a gear box 14 is coupled to the drive sprocket 20. The gear box 14 may encompass motors, cogs, gears, among other elements. In some embodiments, the motors and/or gears may be coupled to the axle 36 configured to rotate the drive sprocket 12 of each of the one, two, three, four, five, six, seven, eight, nine, ten, or more chain assemblies. In other embodiments, the motors and/or the gears may be coupled to the drive sprocket of each of the one, two, three, four, five, six, seven, eight, nine, ten, or more chain assemblies.

Figure 3:
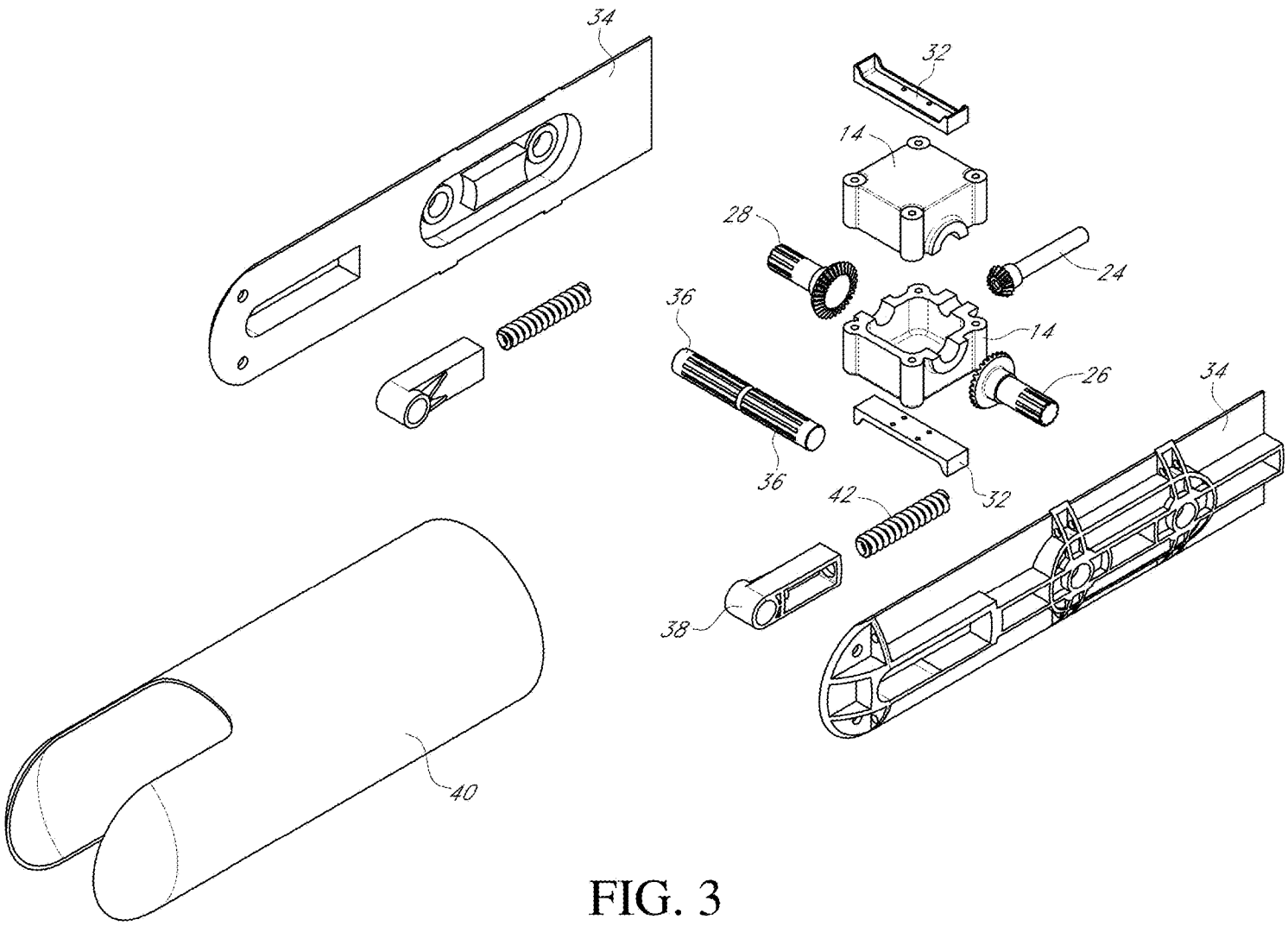
FIG. 3 is an exploded view of a portion of the drill bit.
Figure 4:
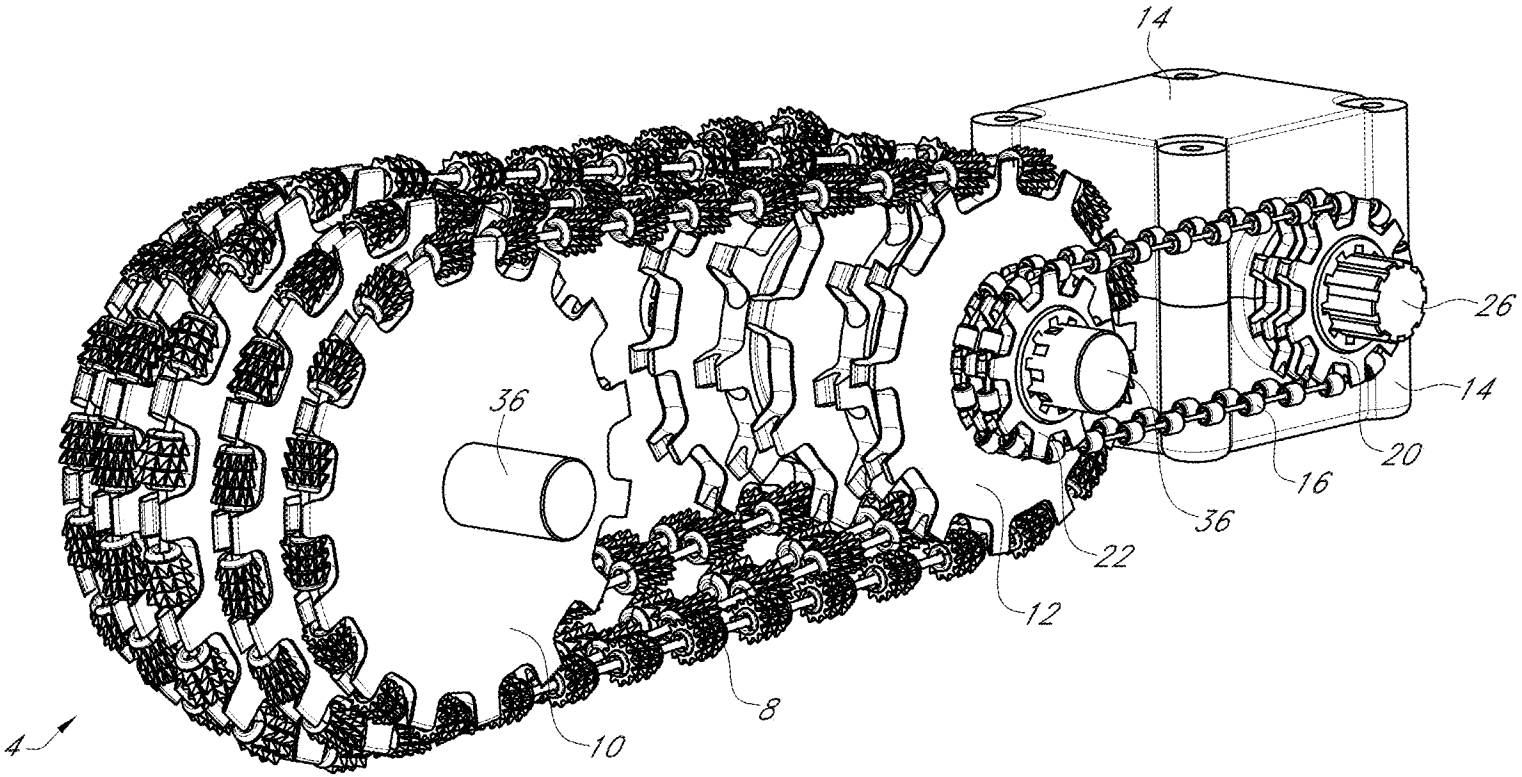
FIG. 4 shows some of the internal components of a drill bit.

The internal components of one embodiment of gear box 14 are shown in FIG. 3. The gear box 14 can have an outer housing, such as the two part outer housing shown. It can include a number of gears, such as bevel gears 24, 26, 28. The first bevel gear 24 can drive the other two bevel gears 26, 28. The gear box can be driven through a mud motor, other type of motor or other type of source. The motor or source (not shown) can be located in the drill bit, or the larger drilling system. In the illustrated embodiment, the gear box 14 can drive the bevel gears 26, 28 in opposite directions. This can be used to drive some of the chain assemblies of the drill bit in opposite directions.

FIG. 3 also illustrates a number of brackets 32, 34 that can be used to secure the gear box 14 and chain assemblies 4. The brackets 34 can hold two splined axles 36 to secure the sprockets 10, 12 of the chain assemblies 4. The front axle 36 can be held under spring tension with shaft brackets 38 and springs 42. FIG. 3 also shows the housing 40. The nozzle 6 is not shown in the housing 40, but it will be understood that it can be included in other embodiments.

Figure 5:
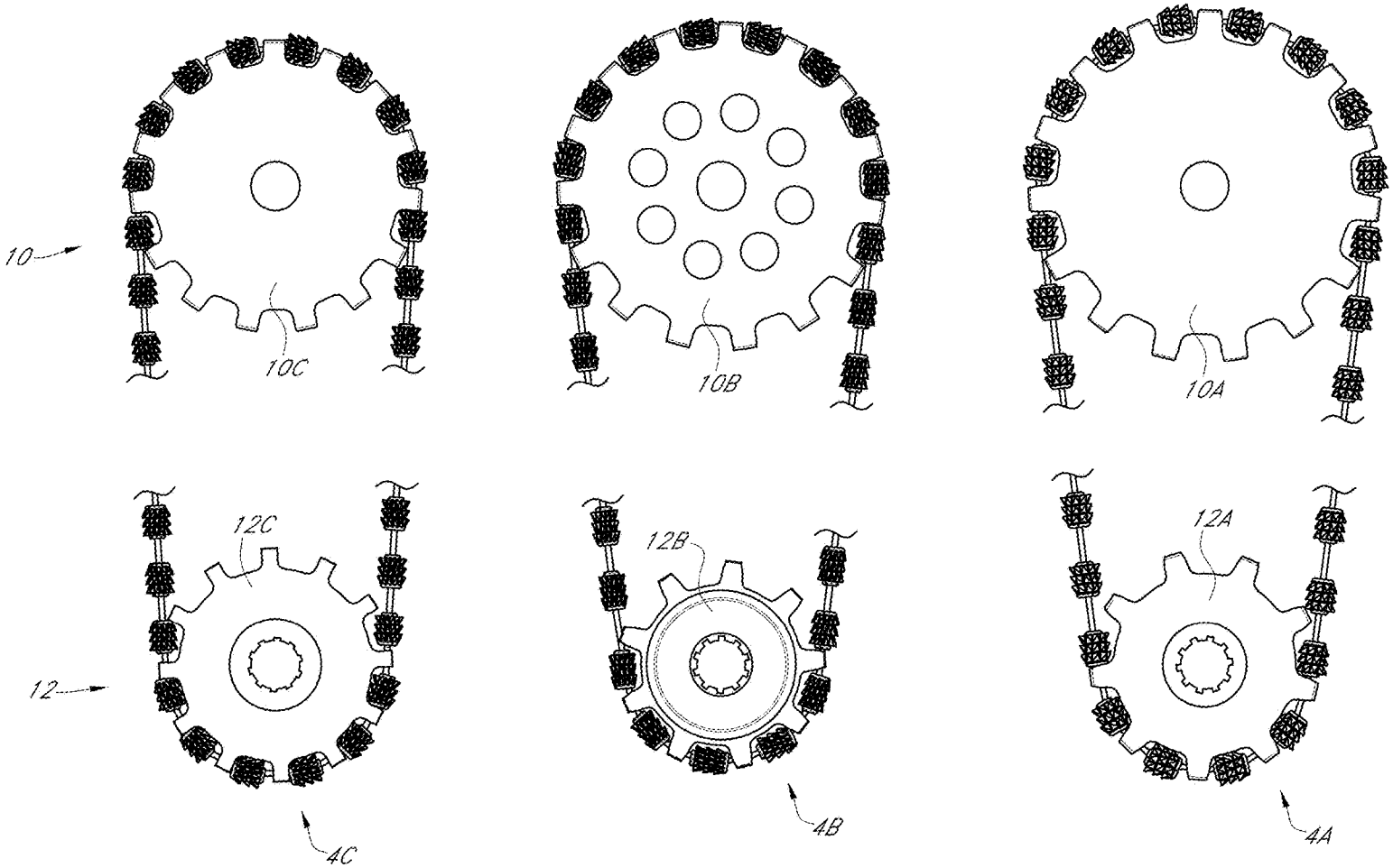
FIG. 5 compares the relative size of three chain assemblies.

A drilling system may comprise a plurality of chain assemblies 4. In some embodiments, the drilling system may include a center chain assembly, an outer chain assembly, and at least one additional chain assembly. In some embodiments, the drilling system may comprise one, two, three, four, five, six, seven, eight, nine, ten, or more chain assemblies. In some embodiments, the drilling system may advantageously comprise at least five chain assemblies. In some embodiments, each of the chain assemblies may comprise a chain, a front sprocket, and/or a drive sprocket as illustrated in FIG. 5. The drive sprocket 12 may have a smaller diameter, substantially the same diameter, or a larger diameter than the front sprocket 10.

FIG. 5 compares the relative size of three chain assemblies 4A, 4B, 4C. The drill bit can create a spherical cutting end by having chain assemblies of different sizes. For example, as illustrated the front sprockets 10 can decrease in size from the center chain assembly shown on the right to the outermost chain assembly shown at the left. As illustrated, the center front sprocket 10A is larger than both the second front sprocket 10B and the outermost front sprocket 10C. The drive sprockets 12 are smaller than the front sprockets 10, but they can all be the same size, or different sizes. In some embodiments, the outermost drive sprocket 12C is larger than both the second drive sprocket 12B and the center drive sprocket 12A. The center drive sprocket 12A can be the smallest drive sprocket 12. Thus, in some embodiments, the front sprockets decrease in size from the center front sprocket to the outer most front sprockets on either side, and the drive sprockets have the opposite configuration with the largest drive sprockets being the outermost drive sprockets and the center drive sprocket being the smallest.

Figure 6:
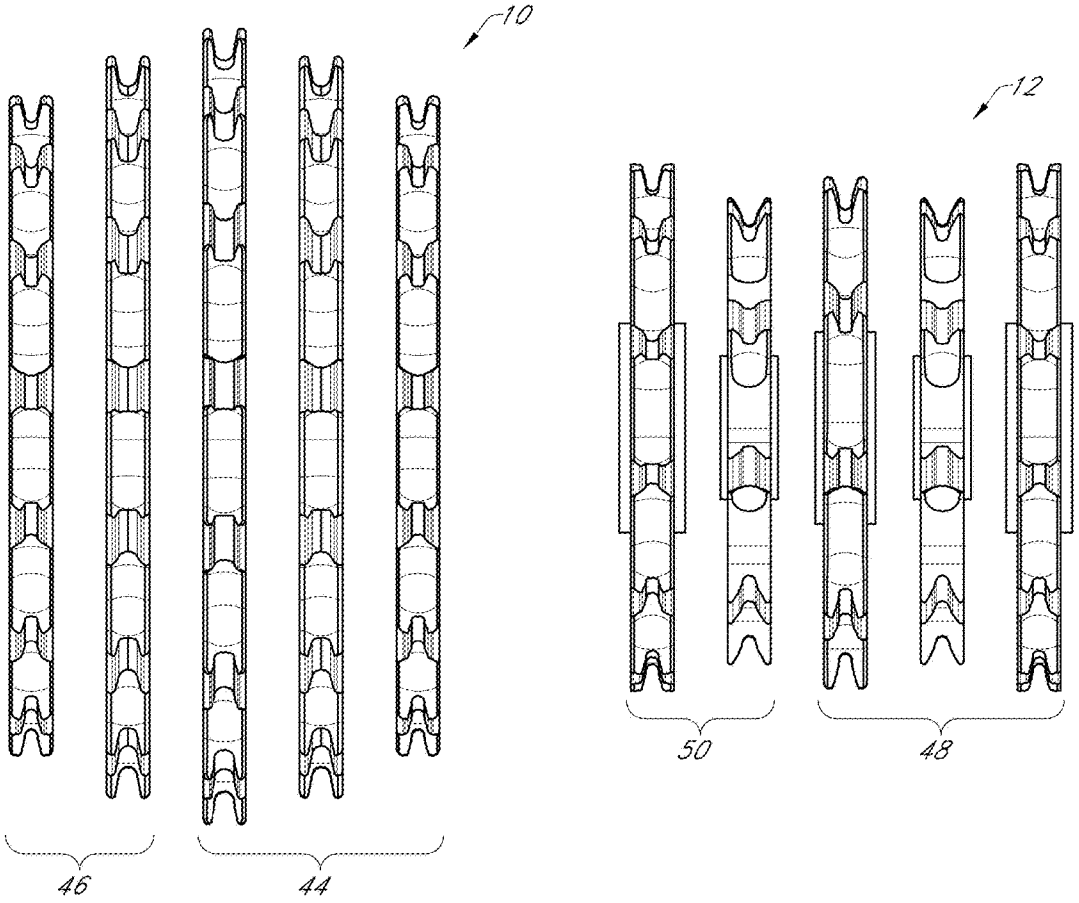
FIG. 6 illustrates a set of front sprockets and a set of drive sprockets of a number of chain assemblies.

FIG. 6 illustrates a set of front sprockets 10 and a set of drive sprockets 12 of a number of chain assemblies. It can be seen that the sprockets can be coupled together into groups 44, 46, 48, 50 to thereby rotate together. The groupings can be 1:2, 2:3 (as shown), 4:5, etc. With a center chain assembly 4A, the groupings will preferably be different by one chain assembly, such as the two front sprockets in one group 46 and three front sprockets in the second group 44. In some embodiments, the front sprockets are coupled together in groups and the drive sprockets are coupled together in corresponding groups. In other embodiments, the drive sprockets are coupled together in groups and the front sprockets are not coupled together.

Figure 7A:
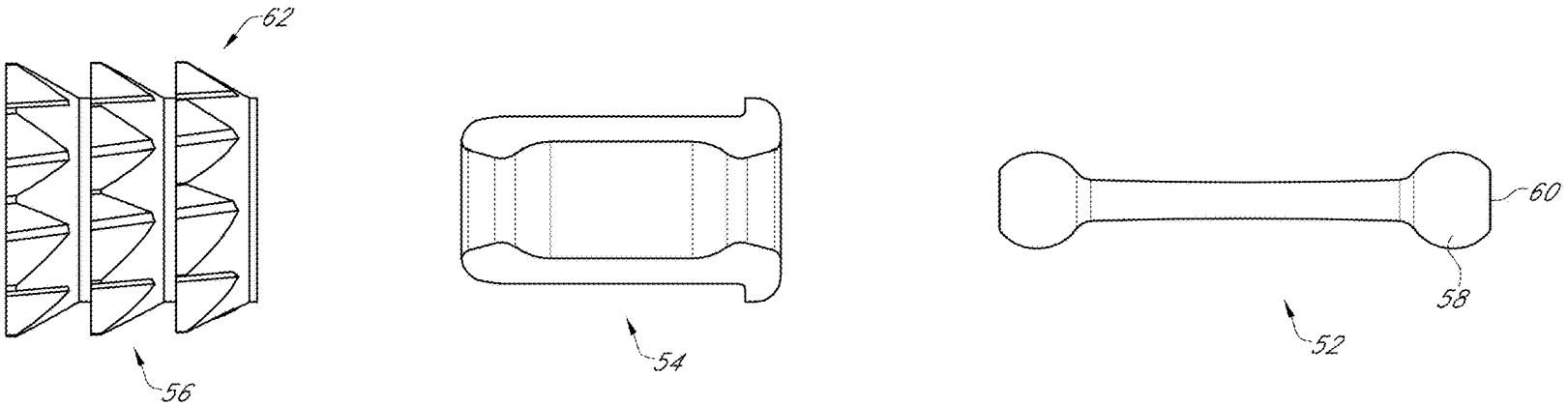
FIG. 7A shows a side view of a number of components that combine to form a chain.
Figure 7B:
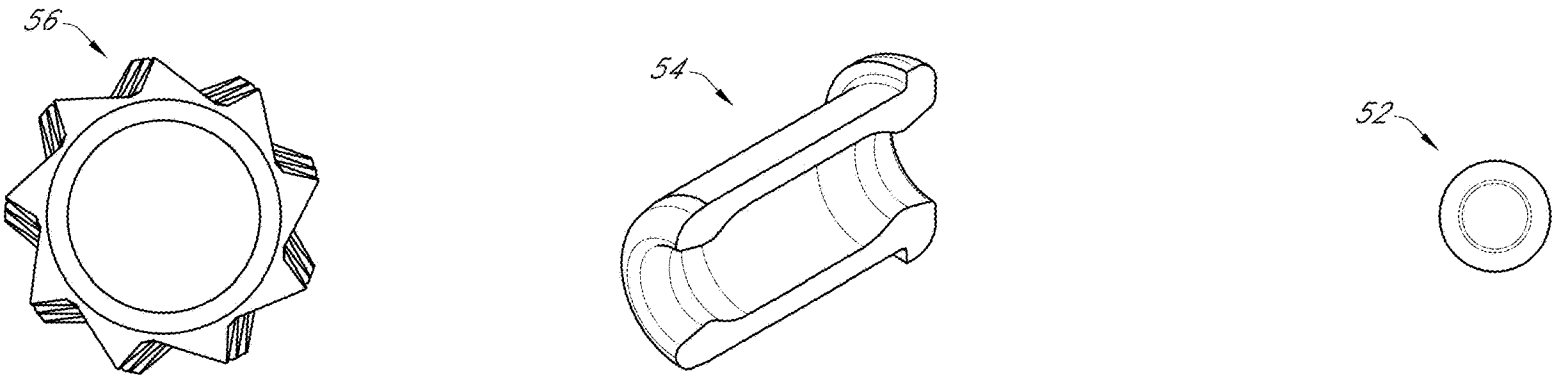
FIG. 7B illustrates the components of FIG. 6A from a different angle.
Figure 8:
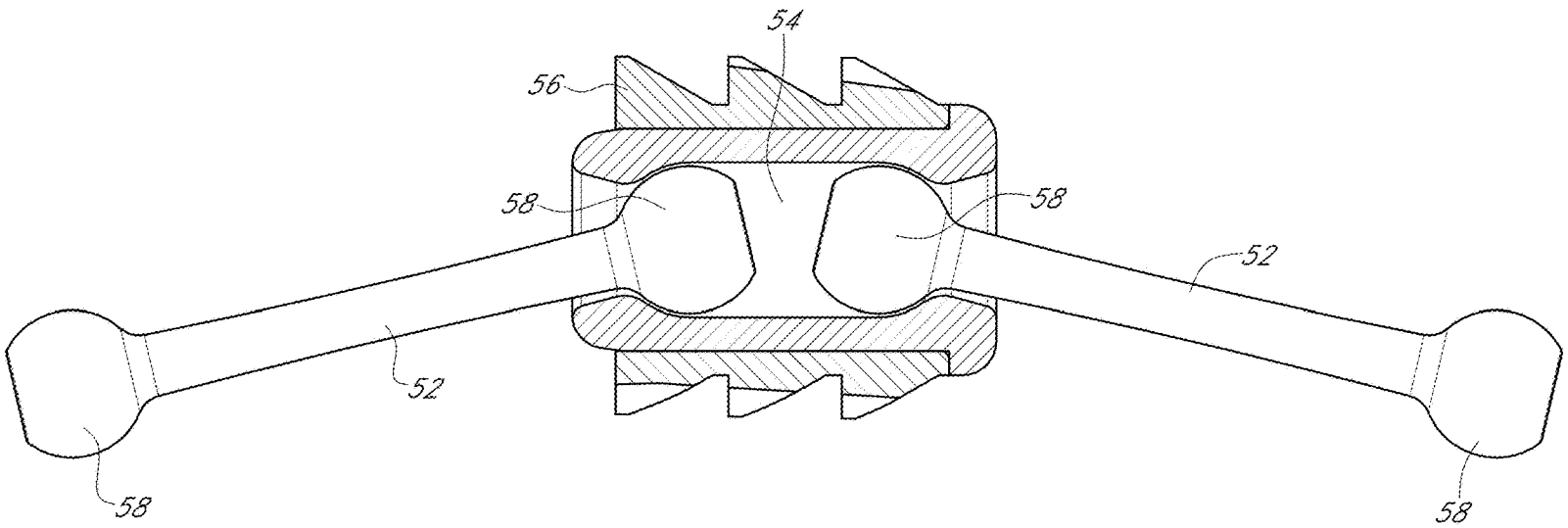
FIG. 8 illustrates a portion of a chain.

A chain may be made up of a number of components including links 52, half shells 54, and cutter shells 56, as shown in FIGS. 7A-8. As can be seen with reference to FIG. 8, the ball end 58 of two different links 52 reside within a pair of half shells 54. A cuter shell 56 is positioned around the pair of half shells 54 to hold the assembly together. Looking at FIG. 7A it can be seen that in some embodiments, the ball end 58 can have a flat tip 60. Each link can have two ends and a shaft. Each of the two ends of each link can be ball-shaped to form an overall barbell-like shape. In other embodiments, the link may form other shapes. The chain may be connectable to teeth of the drive sprocket and teeth of the front sprocket.

A first half shell 54 and a second half shell 54 may be coupled to one another to enclose the end 58 of a first link 52 and an end 58 of a second link 52 to form a portion of the chain. This enclosure is advantageous for several reasons.

The coupling of the first half shell to the second half shell provides support for the chain of the each of the one, two, three, four, five, six, seven, eight, nine, ten, or more chain assemblies by allowing the chains to remain in tension. Also, coupling the first half shell to the second half shell enables lubricant to be applied within the enclosure, allowing each end of the first link and the second link to rotate freely within the enclosure. The lubricant within the enclosure can advantageously be sealed off from the environment by the tension of the chain, preventing the internal elements from being exposed.

A cutter shell 56 may be coupled to and/or encompass all or part of the first half shell 54 and the second half shell 54. This enclosure could advantageously provide support to the chain. In some embodiments, each cutter shell may include a plurality of teeth 62 organized in one or more rows. In some embodiments, at least fifteen teeth may be aligned in rows along an outer surface of each cutter shell or have no pattern. Each cutter shell may be allowed to rotate freely in a clockwise or counterclockwise direction. Cutter shells having at least fifteen teeth are advantageous because the plurality of teeth would remain sharp for a longer period of time. As illustrated, the cutter shell 56 has three rows of nine teeth each for a total of twenty-seven (27) teeth.

Figure 9C:
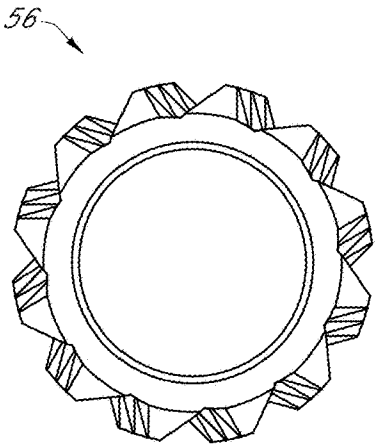
FIGS. 9A-C show another embodiment of cutter shell.
Figure 9B:
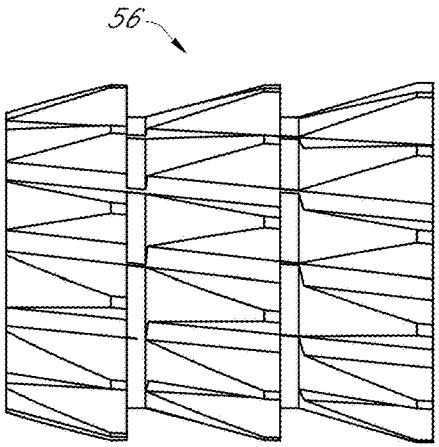
Figure 9A:
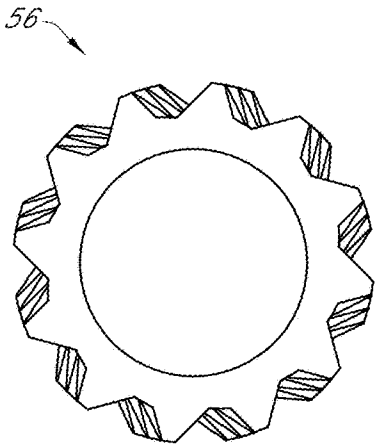

FIGS. 9A-C show another embodiment of cutter shell. As illustrated, the cutter shell 56 has three rows of twelve teeth each for a total of thirty-six (36) teeth. Comparing the cutter shell 56 of FIGS. 9A-C with that of FIGS. 7A-B it will be noted that the later has a smaller radial offset between the rows. In some embodiments, the center chain assembly can include cutter shells with less teeth than the other chain assemblies. In some embodiments, each chain assembly uses one style of cutter shell, and at least some of the chain assemblies use different styles. Returning to FIG. 4, it can be seen that the outermost chain assemblies on either side have cutter shells that are smaller than the cutter shells of the other chain assemblies. In addition, the outermost chain assemblies and the center chain assembly have three rows of teeth, while middle chain assemblies have four rows of teeth on their cutter shells. In addition, separate sets or groups of chain assemblies can rotate in different directions and so the cutter shells can be orientated in opposite directions. In some embodiments, the teeth on adjacent cutter shells on the same chain can be angled to opposite sides, so that adjacent teeth on a chain rotate in opposite directions when in contact with a material to cut.

Adjacent rows of teeth can be aligned with a small radial offset. This can cause the cutting shell 56 to rotate as it cuts. It will be understood that the number of teeth, the tooth angle, the offset between rows, and other factors can influence the speed of rotation of the cutter shell and the effectiveness of the cutting action in a particular type of material.

In some embodiments, the chains across chain assemblies are the same length, the cutter shells are the same size and the cogs vary in size decreasingly on the cutting end and increasingly on the drive side. In some embodiments, the cutter shells are different sizes, the chains are different sizes, and there are the same number of teeth on adjacent cogs.

A chain is mounted in a housing forming the bit. The outer face of chain links can be provided with diamonds and/or synthetic diamond compacts and multiple links are selectively positioned at the bottom of the drill bit to engage the hard rock and drill a borehole. The drilling action of the bit is generated by the rotation of the entire body of the bit thereby moving the diamond-studded links in a rotative pattern against the rock. When the drilling efficiency of the bit decreases to the point where movement is too slow for economic operation, thus indicating that the diamonds are worn, the bit is lifted from the bottom of the borehole and the chain is cycled to bring the next multiple of chain links into the working position. Continuous chain bits are thus, in theory, very efficient, since no longer is the drill bit required to be removed from the borehole when the diamonds are worn. A bit can remain in the borehole through five or more drilling cycles, saving substantial time and expense normally required to raise a bit and replace it.

A drilling apparatus can be used in a cutting or drilling tool for many different applications. For example, the drilling apparatus may be used to drill a hole into the ground, rock, or other surface for water and/or oil, among other substances. In an embodiment, the drilling apparatus may be used as a drill bit. In another embodiment, the drilling apparatus may be used to bore a hole during various processes, such as fracking for example. In yet another embodiment, the drilling apparatus may be used to ream a hole to form a consistent and/or smooth surface.

Some embodiments have been described in connection with the accompanying drawings. The figures are drawn to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

The terms "approximately," "about," and "substantially" as used herein represent an amount close to the stated amount that still performs a desired function or achieves a desired result. For example, in some embodiments, as the context may permit, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may permit, the term "generally parallel" can refer to something that departs from exactly parallel by less than or equal to 20 degrees, and the term "generally perpendicular"can refer to something that departs from exactly perpendicular by less than or equal to 20 degrees.

Although this disclosure has been disclosed in the context of certain preferred embodiments and examples, it will be understood by those skilled in the art that this disclosure extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the invention herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A drilling system comprising:

a drill bit, the drill bit defining a longitudinal axis between a distal end and a proximal end, the drill bit configured to rotate about the longitudinal axis and to cut material at the distal end, the drill bit comprising:

a plurality of chain assemblies, each of the plurality of chain assemblies comprising:

a chain made up of a plurality of cutters, each cutter having teeth positioned in rows extending radially around the cutter, the teeth configured to rotate axially as the teeth engage a material for cutting;

a proximal cog with a first set of gear teeth configured to drive the chain; and a distal cog configured with a second set of gear teeth configured to engage the chain, the drill bit configured to cut material with each chain at each distal cog;

wherein the plurality of chain assemblies comprises at least a first chain assembly and a second chain assembly, the proximal cog of the first chain assembly configured to drive the first chain assembly in a direction opposite of the proximal cog of the second chain assembly; and wherein in a moment of time, the teeth on longitudinally adjacent cutters of the first chain assembly rotate in opposite directions when they engage a material for cutting.

2. The drilling system of claim 1, wherein the distal cog of each of the plurality of chain assemblies has a larger diameter than the proximal cog.

3. The drilling system of claim 1, further comprising a third chain assembly, wherein the first chain assembly is position in between the second and third chain assemblies and the third chain assembly rotates in the same direction as the first chain assembly.

4. The drilling system of claim 3, wherein the first chain assembly is mechanically coupled to the third assembly such that they move together.

5. The drilling system of claim 1, wherein all of the proximal cogs of the plurality of chain assemblies are coupled together into a first group and a second group to thereby rotate together as a group, with the first group rotating in a direction opposite the second group.

6. The drilling system of claim 5, wherein the first group has a single chain assembly more than the second group.

7. The drilling system of claim 5, wherein each chain assembly of the first group is disposed directly adjacent to at least one other chain assembly of the first group.

8. The drilling system of claim 1, wherein the distal cogs decrease in size from a center distal cog to an outer most distal cog on either side.

9. The drilling system of claim 8, wherein the proximal cogs have the largest proximal cogs being outermost and a center proximal cog being the smallest.

10. The drilling system of claim 1, wherein a center chain assembly of the plurality of chain assemblies comprises cutters that are larger than cutters of the other chain assemblies of the plurality of chain assemblies.

11. The drilling system of claim 1, wherein the drill bit is configured to stabilize the drilling apparatus and counteract lateral movement of the drilling apparatus by balancing countervailing moments caused by the rotation of the drill bit about the longitudinal axis and rotation of each of the plurality of chain assemblies about a perpendicular axis.

12. The drilling system of claim 1, wherein the drill bit is configured to maintain rotation in a constant direction about the longitudinal axis while the orientation of the plurality of chain assemblies varies.

* * * * *